US011761124B1

(12) United States Patent
Boyette et al.

(10) Patent No.: US 11,761,124 B1
(45) Date of Patent: Sep. 19, 2023

(54) ELASTIC FLAME-RESISTANT FABRIC

(71) Applicant: Milliken & Company, Spartanburg, SC (US)

(72) Inventors: Rachel W. Boyette, Taylors, SC (US); Stephen D. Lucas, Boiling Springs, SC (US)

(73) Assignee: Milliken & Company, Spartanburg, SC (US)

( * ) Notice: Subject to any disclaimer, the term of this patent is extended or adjusted under 35 U.S.C. 154(b) by 1 day.

(21) Appl. No.: 17/470,374

(22) Filed: Sep. 9, 2021

(51) Int. Cl.

| | |
|---|---|
| ***D03D 15/208*** | (2021.01) |
| ***D03D 15/283*** | (2021.01) |
| ***D03D 15/47*** | (2021.01) |
| ***D03D 15/56*** | (2021.01) |
| ***D03D 15/513*** | (2021.01) |
| ***D02G 3/32*** | (2006.01) |
| ***D02G 3/38*** | (2006.01) |
| ***D02G 3/44*** | (2006.01) |
| ***D02G 3/04*** | (2006.01) |

(52) U.S. Cl.
CPC ..... *D02G 3/443* (2013.01); *D02G 3/045* (2013.01); *D02G 3/047* (2013.01); *D02G 3/32* (2013.01); *D02G 3/38* (2013.01); *D03D 15/208* (2021.01); *D03D 15/283* (2021.01); *D03D 15/47* (2021.01); *D03D 15/513* (2021.01); *D03D 15/56* (2021.01); *D10B 2321/101* (2013.01); *D10B 2331/021* (2013.01)

(58) Field of Classification Search
None
See application file for complete search history.

(56) References Cited

U.S. PATENT DOCUMENTS

| | | | |
|---|---|---|---|
| 2,828,228 | A | 3/1958 | Glade |
| 3,640,823 | A | 2/1972 | Linderman |
| 4,282,283 | A | 8/1981 | George |
| 4,533,592 | A | 8/1985 | Bingham |
| 4,569,088 | A | 2/1986 | Frankenburg |
| 5,149,582 | A | 9/1992 | LaMarca, II |
| 5,279,287 | A | 1/1994 | Wiseman, Sr. |
| 5,506,043 | A | 4/1996 | Lilani |
| 5,727,401 | A | 3/1998 | Statham |
| 6,787,228 | B2 | 9/2004 | Campbell |
| 6,823,548 | B2 | 11/2004 | Murphy |
| 7,168,140 | B2 | 1/2007 | McKee |
| 7,182,991 | B1 | 2/2007 | Hirschmann, Jr. |
| 7,226,877 | B2 | 6/2007 | Bascom |
| 7,247,585 | B2 | 7/2007 | Bascom |
| 7,259,117 | B2 | 8/2007 | Mater |
| 7,393,800 | B2 | 7/2008 | Corner |
| 7,484,256 | B2 | 2/2009 | Murphy |
| 7,589,036 | B2 | 9/2009 | Corner |
| 7,589,037 | B2 | 9/2009 | Handermann |
| 7,601,414 | B2 | 10/2009 | Handermann |
| 8,722,145 | B2 | 5/2014 | Panse |
| 8,732,863 | B2 | 5/2014 | Hines |
| 8,741,789 | B2 | 6/2014 | Li |
| 9,034,777 | B2 | 5/2015 | Hines |
| 9,370,212 | B2 | 6/2016 | Zhu |
| 9,885,128 | B2 | 2/2018 | Cliver |
| 9,920,474 | B2 | 3/2018 | Bonner |
| 9,926,663 | B2 | 3/2018 | Valenta |
| 10,030,326 | B2 | 7/2018 | Hines, Jr. |
| 10,202,720 | B2 | 2/2019 | Cliver |
| 2001/0009832 | A1 | 7/2001 | Shaffer |
| 2002/0142686 | A1 | 10/2002 | Lapierre |
| 2003/0148689 | A1 | 8/2003 | Lapierre |
| 2003/0228812 | A1 | 12/2003 | Stanhope |
| 2003/0232560 | A1 | 12/2003 | Corner |
| 2004/0060119 | A1 | 4/2004 | Murphy |
| 2004/0060120 | A1 | 4/2004 | Murphy |
| 2004/0152378 | A1 | 8/2004 | Stanhope |
| 2004/0192134 | A1 | 9/2004 | Gibson |
| 2005/0025963 | A1 | 2/2005 | Zhu |
| 2005/0079783 | A1 | 4/2005 | Campbell |
| 2005/0097877 | A1 | 5/2005 | Hainsworth |
| 2005/0186875 | A1 | 8/2005 | Lilani |
| 2005/0204718 | A1 | 9/2005 | Zhu |
| 2005/0208855 | A1 | 9/2005 | Zhu |
| 2005/0255771 | A1 | 11/2005 | Chetty |
| 2006/0030228 | A1 | 2/2006 | Truesdale, III |
| 2006/0040575 | A1 | 2/2006 | Kelleher |
| 2006/0059634 | A1 | 3/2006 | Tutterow |
| 2006/0068664 | A1 | 3/2006 | Gibson |
| 2006/0111000 | A1 | 5/2006 | Bascom |
| 2006/0135014 | A1 | 6/2006 | Murphy |
| 2006/0135023 | A1 | 6/2006 | Knoff |
| 2006/0141880 | A1 | 6/2006 | Bascom |
| 2006/0160454 | A1 | 7/2006 | Handermann |

(Continued)

FOREIGN PATENT DOCUMENTS

| | | |
|---|---|---|
| CA | 2814640 | 4/2012 |
| EP | 3425093 | 1/2019 |

(Continued)

OTHER PUBLICATIONS

PCT/US2020/048319 Search Report, dated Jan. 18, 2021.
PCT/US2020/048319 Written Opinion.

*Primary Examiner* — Shawn Mckinnon
(74) *Attorney, Agent, or Firm* — Cheryl J. Brickey

(57) ABSTRACT

An elastic flame-resistant yarn containing an intimate fiber blend of staple fibers wrapped around a plurality of elastic continuous fibers. The intimate fiber blend of staple fibers contains non-flame-resistant (FR) cellulosic fibers, modacrylic fibers, and aramid fibers. The non-FR cellulosic fibers constitute at least about 31% by weight to at most about 54% by weight of the intimate fiber blend of staple fibers, the modacrylic fibers constitute at least about 30% by weight to at most about 49% by weight of the intimate fiber blend of staple fibers, and the aramid fibers make up at least about 3% by weight to at most about 20% by weight of the intimate fiber blend of staple fibers. The elastic continuous fibers make up at least about 0.01% by weight to at most about 5% by weight of the elastic flame-resistant yarn.

4 Claims, No Drawings

(56) References Cited

U.S. PATENT DOCUMENTS

| | | | | |
|---|---|---|---|---|
| 2006/0292953 | A1* | 12/2006 | Ashley | D02G 3/047 442/310 |
| 2007/0004302 | A1 | 1/2007 | McKinnon | |
| 2007/0077839 | A1 | 4/2007 | McKinnon | |
| 2007/0224900 | A1 | 9/2007 | Tucker | |
| 2007/0275617 | A1 | 11/2007 | Harris | |
| 2008/0057807 | A1 | 3/2008 | Tutterow | |
| 2008/0085651 | A1 | 4/2008 | Handermann | |
| 2008/0098503 | A1 | 5/2008 | Swartz | |
| 2008/0299854 | A1 | 12/2008 | Hilleary | |
| 2009/0111345 | A1 | 4/2009 | Panse | |
| 2009/0178186 | A1 | 7/2009 | Truesdale | |
| 2010/0112312 | A1 | 5/2010 | Tutterow | |
| 2010/0281923 | A1 | 11/2010 | Zumloh-Nebe | |
| 2010/0297905 | A1 | 11/2010 | Ulrich | |
| 2010/0298454 | A1 | 11/2010 | Chew | |
| 2010/0319850 | A1 | 12/2010 | Panse | |
| 2011/0104466 | A1 | 5/2011 | Atkinson | |
| 2011/0173734 | A1 | 7/2011 | Mikhail | |
| 2011/0183561 | A1 | 7/2011 | Panse | |
| 2011/0275267 | A1 | 11/2011 | Smith | |
| 2012/0090080 | A1 | 4/2012 | Stanhope | |
| 2012/0144794 | A1 | 6/2012 | Ke | |
| 2012/0146784 | A1 | 6/2012 | Hines | |
| 2012/0167269 | A1 | 7/2012 | Hernandez | |
| 2012/0171918 | A1 | 7/2012 | Lawson, III | |
| 2012/0183747 | A1 | 7/2012 | Bader | |
| 2012/0260422 | A1 | 10/2012 | Rock | |
| 2013/0022805 | A1 | 1/2013 | Small, Jr. | |
| 2013/0042385 | A1 | 2/2013 | Hines | |
| 2013/0055490 | A1 | 3/2013 | Zhu | |
| 2013/0064570 | A1 | 3/2013 | Yamane | |
| 2013/0065470 | A1 | 3/2013 | Rock | |
| 2013/0152262 | A1 | 6/2013 | Bedetti | |
| 2013/0212790 | A1 | 8/2013 | Waxman | |
| 2013/0247287 | A1 | 9/2013 | Mizobuchi | |
| 2014/0041107 | A1 | 2/2014 | Rose | |
| 2014/0075659 | A1 | 3/2014 | Li | |
| 2014/0113122 | A1 | 4/2014 | Smith | |
| 2014/0261852 | A1 | 9/2014 | Bonner | |
| 2017/0310032 | A1 | 10/2017 | Sasaki | |
| 2018/0057964 | A1 | 3/2018 | Andersen | |
| 2018/0057978 | A1 | 3/2018 | Zhu | |
| 2018/0171516 | A1 | 6/2018 | Stanhope | |
| 2019/0106816 | A1* | 4/2019 | Beagle | D03D 11/00 |

FOREIGN PATENT DOCUMENTS

| | | | |
|---|---|---|---|
| WO | 2004005606 | | 1/2004 |
| WO | 2004088023 | | 10/2004 |
| WO | 2005090660 | | 9/2005 |
| WO | 2006017709 | | 2/2006 |
| WO | 2008027454 | | 3/2008 |
| WO | 2011137213 | A2 | 11/2011 |
| WO | 2012121759 | | 9/2012 |

* cited by examiner

ELASTIC FLAME-RESISTANT FABRIC

TECHNICAL FIELD

The present invention relates generally to elastic flame-resistant yarns and fabric, as well as garments made from those fabrics.

BACKGROUND

In the United States, it is desirable and often required for clothing worn by certain types of workers to pass a dual-hazard performance specification encompassing both the flame-resistance standard F1506 of the American Society for Testing and Materials (ASTM) as well as the flash fire protection standard of NFPA 2112-2012.

In addition to the above-noted performance specifications of fabrics, other properties are also important if a fabric is to be practical and commercially viable, particularly for clothing. For instance, the fabric should be durable under repeated industrial launderings and should have good abrasion-resistance. Furthermore, the fabric should be readily dyeable to dark, solid shades of color, and should be comfortable to wear. It would be desirable to have all of the characteristics above and also have a degree of stretch to the fabric for increased comfort and wearability.

BRIEF SUMMARY OF THE INVENTION

The invention relates to an elastic flame-resistant yarn containing an intimate fiber blend of staple fibers wrapped around a plurality of elastic continuous fibers. The intimate fiber blend of staple fibers contains non-flame-resistant (FR) cellulosic fibers, modacrylic fibers, and aramid fibers. The non-FR cellulosic fibers constitute at least about 31% by weight to at most about 54% by weight of the intimate fiber blend of staple fibers, the modacrylic fibers constitute at least about 30% by weight to at most about 49% by weight of the intimate fiber blend of staple fibers, and the aramid fibers make up at least about 3% by weight to at most about 20% by weight of the intimate fiber blend of staple fibers. The weight ratio of the modacrylic fibers to the cellulosic fibers is at least about 0.75 but less than about 1.0. The elastic continuous fibers make up at least about 0.01% by weight to at most about 5% by weight of the elastic flame-resistant yarn.

In another embodiment the invention relates to an elastic flame-resistant fabric containing a plurality of elastic flame-resistant yarns. The elastic flame-resistant yarns contain an intimate fiber blend of staple fibers wrapped around a plurality of elastic continuous fibers. The intimate fiber blend of staple fibers contains non-flame-resistant (FR) cellulosic fibers, modacrylic fibers, and aramid fibers. The non-FR cellulosic fibers constitute at least about 31% by weight to at most about 54% by weight of the intimate fiber blend of staple fibers, the modacrylic fibers constitute at least about 30% by weight to at most about 49% by weight of the intimate fiber blend of staple fibers, and the aramid fibers make up at least about 3% by weight to at most about 20% by weight of the intimate fiber blend of staple fibers. The weight ratio of the modacrylic fibers to the cellulosic fibers is at least about 0.75 but less than about 1.0. The elastic continuous fibers make up at least about 0.01% by weight to at most about 5% by weight of the elastic flame-resistant yarn.

In another embodiment, the invention relates to a method of making an elastic flame-resistant fabric. The method includes forming an intimate blend of staple fibers which contain non-FR cellulosic fibers, modacrylic fibers, and aramid fibers. The cellulosic fibers constitute at least 31% by weight to at most 54% by weight of the fiber blend, the modacrylic fibers constitute at least 30% by weight to at most 49% by weight of the fiber blend, and the aramid fibers make up at least 3% by weight to at most 20% by weight of the fiber blend. The weight ratio of the modacrylic fibers to the cellulosic fibers is at least 0.75 but less than 1.0. The method also contains the step of spinning a portion of the intimate blend of staple fibers around a plurality of elastic continuous fibers forming a plurality of elastic flame-resistant yarns, where the elastic continuous fibers make up at least about 0.01% by weight to at most about 5% by weight of the elastic flame-resistant yarns. The method also contains the steps of forming a plurality of flame-resistant yarns and knitting or weaving the plurality of flame-resistant yarns and the plurality of elastic flame-resistant yarns to form the elastic flame-resistant fabric.

DETAILED DESCRIPTION

The ASTM F1506 standard, entitled "Standard Performance Specification for Flame Resistant Textiles Materials for Wearing Apparel for Use by Electrical Workers Exposed to Momentary Electrical Arc and Related Thermal Hazards", sets various standard performance specifications for a fabric, among which are specifications for the ability of the fabric to self-extinguish after being ignited. When the ignition source is removed, the fabric must self-extinguish in less than 2 seconds and have less than a 4-inch char length according to ASTM Test Method D6413 ("Standard Test Method for Flame Resistance of Textiles", also referred to as the Vertical Flame test). The F1506 performance standard also includes standard test ASTM 1959 ("Standard Test Method for Determining the Arc Thermal Performance Value of Materials for Clothing"), which measures the level of protection that the fabric provides against electrical arc exposure. The ASTM 1959 test establishes four levels of electrical arc protection as measured by the fabric's Arc Thermal Performance Value (ATPV), expressed in cal/cm$^2$: Level I is 4 cal/cm$^2$; Level II is 8 cal/cm$^2$; Level III is 25 cal/cm$^2$; Level IV is 40 cal/cm$^2$. At least Level II certification (ATPV greater than 8.0 cal/cm$^2$) is required for clothing worn by many electrical utility workers. ASTM F1506 also has minimum performance specifications for tensile breaking strength (40 pounds) and tear-resistance (4.0 pounds) of the fabric under standard test conditions.

The NFPA 2112-2012 specification's notable requirements include a maximum 4-inch char length (both before and after 100 industrial launderings) and a maximum 10% thermal shrinkage.

Flame-resistant fabrics (also variously referred to as "fire-resistant", "flame-retardant", and "fire-retardant" fabrics) are fabrics that, once ignited, tend not to sustain a flame when the source of ignition is removed. A great deal of investigation and research has been directed toward the development and improvement of flame-resistant fabrics for use in various products such as bedding, clothing, and others. Flame-resistant clothing is often worn by workers involved in activities such as industrial manufacturing and processing, fire-fighting, electrical utility work, and other endeavors that entail a significant risk of being exposed to open flame and/or electrical arcs.

Flame-resistant fabrics include both fabrics that are treated to be flame-resistant as well as flame-resistant fabrics made from inherently flame-resistant fibers. The former types of fabrics are not themselves flame-resistant but are made flame-resistant by applying to the fabric a chemical composition that renders the fabric resistant to flame. These types of fabrics are susceptible to losing their flame-resistance when laundered repeatedly because the flame-resistant composition tends to wash out. In contrast, inherently flame-resistant fabrics do not suffer from this drawback because they are made from fibers that are themselves flame-resistant.

Various types of inherently flame-resistant (FR) fibers have been developed, including modacrylic fibers (e.g., PROTEX® modacrylic fibers from Kaneka Corporation of Osaka, Japan), aramid fibers (e.g., NOMEX® meta-aramid fibers and KEVLAR® para-aramid fibers, both from E. I. Du Pont de Nemours and Company of Wilmington, Del.), FR rayon fibers, oxidized polyacrylonitrile fibers, and others. It is common to blend one or more types of FR staple fibers with one or more other types of non-FR staple fibers to produce a fiber blend from which yarn is spun, the yarn then being knitted or woven into fabrics for various applications. In such a fiber blend, the FR fibers render the blend flame-resistant even though some fibers in the blend may themselves be non-FR fibers, because when the FR fibers combust they release non-combustible gases that tend to displace oxygen and thereby extinguish any flame. In such blends, typically there is a greater content of FR fibers than non-FR fibers, on the theory that the flame-extinguishing ability of the FR fibers might be overwhelmed by too much non-FR fiber content. Preferably, the aramid fibers in the intimate fiber blend comprise para-aramid fibers.

The present inventions now will be described more fully hereinafter with reference to particular embodiments and examples of the inventions. However, these inventions may be embodied in many different forms and should not be construed as limited to the embodiments set forth herein; rather, these embodiments are provided so that this disclosure will satisfy applicable legal requirements.

As used herein, "non-FR cellulosic fiber" means any fiber consisting of or made from vegetable source(s) and not treated to be flame-resistant. As used herein, "non-FR synthetic cellulosic fiber" means any "non-FR cellulosic fiber" that is not naturally occurring but is manufactured from vegetable sources. Non-FR synthetic cellulosic fibers can include but are not limited to lyocell (a regenerated cellulose fiber made from dissolving bleached wood pulp, one brand of which is TENCEL®), rayon (a regenerated cellulose fiber, one brand of which is MODAL®), acetate, and the like. In one embodiment, the non-FR cellulosic fibers comprise non-FR synthetic cellulosic fibers.

The invention, in one embodiment, relates to an elastic flame-resistant yarn. The elastic FR yarn contains an intimate fiber blend of staple fibers comprising non-flame-resistant (FR) cellulosic fibers, modacrylic fibers, and aramid fibers intimately blended together and wrapped (or spun) around a plurality of elastic continuous fibers. The blend of staple fibers contains at least about 31% by weight to at most about 54% by weight of non-FR cellulosic fibers, at least about 30% by weight to at most about 49% by weight of modacrylic fibers, and at least about 3% by weight to at most about 20% by weight of aramid fibers. The weight ratio of the modacrylic fibers to the cellulosic fibers is at least about 0.75 but less than about 1.0.

This intimate fiber blend of staple fibers is then preferably wrapped around a plurality of elastic continuous fibers to make an elastic FR yarn. Once formed into the elastic FR yarn, the elastic continuous fibers make up at least about 0.01% by weight to at most about 5% by weight of the flame-resistant yarn. Other methods to warp the intimate blend of fibers around the elastic continuous fibers may be used including spinning/wrapping steps such as air-jet, vortex, ring, core, and ring core spinning.

In a more preferred embodiment, the elastic FR yarn contains an intimate fiber blend of staple fibers comprising non-flame-resistant (FR) cellulosic fibers, modacrylic fibers, and aramid fibers intimately blended together and wrapped around a plurality of elastic continuous fibers. The blend of staple fibers contains at least 31% by weight to at most 54% by weight of non-FR cellulosic fibers, at least 30% by weight to at most 49% by weight of modacrylic fibers, and at least 3% by weight to at most 20% by weight of aramid fibers. The weight ratio of the modacrylic fibers to the cellulosic fibers is at least 0.75 but less than 1.0. Once formed into the elastic FR yarn, the elastic continuous fibers preferably make up at least 0.01% by weight to at most 5% by weight of the flame-resistant yarn.

In another embodiment, the modacrylic fibers constitute at least 36% by weight to at most 49% by weight of the intimate fiber blend of staple fibers and the weight ratio of the modacrylic fibers to the cellulosic fibers is at least 0.8 but less than 1.0.

In another embodiment, the total amount of all non-FR cellulosic fibers in the elastic flame-resistant yarn constitute at least 31% by weight to at most 54% by weight of the intimate fiber blend of staple fibers, the total amount of all the modacrylic fibers in the elastic flame-resistant yarn constitute at least 30% by weight to at most 49% by weight of the intimate fiber blend of staple fibers, the total amount of all the aramid fibers in the elastic flame-resistant yarn make up at least 3% by weight to at most 20% by weight of the intimate fiber blend of staple fibers, and the total amount of all the elastic continuous fibers in the elastic flame-resistant yarn make up at least 0.01% by weight to at most 5% by weight of the elastic flame-resistant yarn.

In another embodiment, the intimate fiber blend of staple fibers comprises: 45% by weight to 54% by weight of the cellulosic fibers; 38% by weight to 45% by weight of the modacrylic fibers; and 3% by weight to 15% by weight of the aramid fibers. In another embodiment, the intimate fiber blend of staple fibers comprises: 45% by weight to 50% by weight of the cellulosic fibers; 38% by weight to 45% by weight of the modacrylic fibers; and 10% by weight to 15% by weight of the aramid fibers.

The elastic continuous fibers give the yarn, fabric, and garment its stretch and recovery, meaning that during normal wearing conditions the yarn, fabric, and garment can stretch a degree and then once that strain is removed or reduced, the yarn, fabric, and garment go back to the approximate original length and shape. Having the elastic FR yarn contain up at least 0.01% by weight to at most 5% by weight of the flame-resistant yarn has been found to make a yarn that has good elastic properties while still maintaining the desired FR and other performance characteristics. In one embodiment, the elastic continuous fibers make up at least 1% by weight to at most 5% by weight of the elastic flame-resistant yarn. The elastic continuous fibers may be any suitable continuous fiber that has a suitable amount of stretch and recovery. In one embodiment, the elastic continuous fibers contain a polyether-polyurea copolymer which is also known as SPANDEX® brand fibers.

The elastic FR yarns of the invention and all of the disclosed variations thereof, can be made into an elastic FR fabric. The fabric can be any fabric such as a woven, nonwoven, or knit fabric. The fabric may have any suitable weight for the desired end use, and in one embodiment has a weight of 4.0 oz/yd$^2$ to 12.0 oz/yd$^2$. Preferably, the elastic FR fabric is a woven fabric made up of warp yarns and weft yarns. In one embodiment, the woven elastic FR fabric contains at least 95% by number flame-resistant yarns in the warp direction and a pick and pick (1:1 alternating pattern) arrangement of flame-resistant yarns and elastic flame-resistant yarns. In this embodiment, the elastic flame-resistant fabric comprises less than about 30% by number elastic flame-resistant yarns, more preferably less than about 25% by number.

In other fabric embodiments, the elastic FR fabric contains between about 5 and 95% by number elastic FR yarns, more preferably between about 10 and 50% by number, more preferably between about 15 and 40% by number. In another embodiment the elastic FR fabric can contain between 1% and 20, 30, 35, 40, and 50% by number elastic FR yarns. In another embodiment the elastic FR fabric can contain between 1% and 20, 30, 35, 40, and 50% by weight elastic FR yarns.

The elastic FR fabric may be used for any suitable end use product including garments. The elastic FR garment may be any garment that requires stretch and FR properties. The garment may be, for example, a shirt, pants, outerwear, hat, shoes, gloves, or a vest.

The flammability test according to standard ASTM D6413 entails vertically suspending a fabric sample measuring 12 inches long by 3 inches wide (with the length direction vertical) and igniting the lower end of the fabric and then removing the source of ignition. The duration of the afterflame following removal of the ignition source is measured in seconds, and the char length of the charred portion of the fabric is measured. The fabric is tested in both warp and fill directions (i.e., samples having the length direction parallel to the warp direction are tested and other samples having the length direction parallel to the fill direction are tested). Preferably, wherein the elastic flame-resistant fabric has an average char length less than about 5 inches, more preferably less than about 2.5 inches when tested in accordance with ASTM D6413. Additionally, the elastic flame-resistant fabric preferably has a thermal shrinkage less than 12.0%, more preferably less than about 10.0%, more preferably less than about 9.0% when tested in accordance with NFPA 2112-2012.

The dyeability properties of the elastic yarns, fabric, and garments are also important. An advantage of the fiber blend of the invention is that the chemicals and temperatures required for dyeing the various types of fibers do not interact negatively with each other. Advantageously, the fabric contains less than 15 percent of the para-aramid fibers (which are not dyeable), and thus is over 85 percent dyeable. Therefore, dark, solid shades can be achieved by dyeing each of the dyeable fiber types in the fabric. The dyes are all applied in an exhaust dyeing procedure. The preferred dye procedure is to dye the fabric (or the yarn from which the fabric is made) first with basic dyes to dye the modacrylic fibers. Next the fabric or yarn is dyed with fiber reactive or direct dyes to dye the cotton fibers. Finally, the fabric or yarn is dyed with acid or disperse dyes to dye the nylon fibers. The maximum temperature reached in the dye bath is not greater than 230° F. in each dyeing procedure. The modacrylic fibers cannot withstand temperatures greater than 230° F. Optionally, one or more dye fixatives can be used for fixing one or more of the dyes. In one preferred embodiment, the modacrylic fibers are dyed with basic dye and the cellulosic fibers are dyed with fiber reactive or direct dye.

Fabric made in accordance with the invention may also be vat dye printable. The military has a nylon/cotton product that it uses for camouflage garments. The current military fabric is not fire-resistant. The fabric of the present invention may provide a fire-resistant fabric that is printable with a camouflage pattern.

Fiber blends in accordance with the invention can be made from fibers having various staple fiber lengths and various deniers. Suitably, the fibers can range in length from about 0.5 inch to about 2.5 inches. In the trials reported above, fiber lengths were in the 1.5 to 2.0 inch range. The modacrylic, cellulosic, and para-aramid fibers can have a denier ranging from about 0.5 to about 3.0. In the trials reported above, fiber deniers were in the 1.2 to 1.5 range. Yarns can be made in accordance with the invention in various sizes, as single-ply or two-ply yarn, although two-ply yarns are preferred for strength and durability. With respect to two-ply yarns, the yarns can vary in cotton count sizes from 64/2 to 15/2, more preferably from about 38/2 to 15/2. In the trials reported above, yarn sizes ranged from 18/2 for the heavier-weight fabrics to 34/2 for the lighter-weight fabrics. The yarns can be ring-spun, air jet-spun, vortex spun, or open-end-spun.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of making an elastic flame-resistant fabric, comprising the steps of:

forming an intimate blend of staple fibers, the staple fibers comprising non-FR cellulosic fibers, modacrylic fibers, and aramid fibers, wherein: the cellulosic fibers constitute at least 31% by weight to at most 54% by weight of the fiber blend; the modacrylic fibers constitute at least 30% by weight to at most 49% by weight of the fiber blend, where a weight ratio of the modacrylic fibers to the cellulosic fibers is at least 0.75 but less than 1.0; and the aramid fibers make up at least 3% by weight to at most 20% by weight of the fiber blend;

spinning a portion of the intimate blend of staple fibers around a plurality of elastic continuous fibers forming a plurality of elastic flame-resistant yarns, wherein the elastic continuous fibers make up at least about 0.01% by weight to at most about 5% by weight of the elastic flame-resistant yarns;

forming a plurality of flame-resistant yarns; and, knitting or weaving the plurality of flame-resistant yarns and the plurality of elastic flame-resistant yarns to form the elastic flame-resistant fabric, wherein the elastic flame-resistant fabric comprises less than about 25% by number elastic flame-resistant yarns.

2. The method of claim 1, wherein the elastic flame-resistant fabric is a woven fabric having a plurality of warp yarns and a plurality of weft yarns, wherein the warp yarns comprise at least 95% by number flame-resistant yarns and the weft yarns comprise a pick and pick arrangement of flame-resistant yarns and elastic flame-resistant yarns.

3. The method of claim 1, further comprising the steps of: dyeing the modacrylic fibers with basic dye and dyeing the cellulosic fibers with fiber reactive or direct dye.

4. The method of claim 1, wherein the spinning steps each are selected from the group consisting of airjet, vortex, ring, core, and ring core spinning the blend of staple fibers into yarn.

* * * * *